United States Patent [19]

Buchner

[11] 4,252,521

[45] Feb. 24, 1981

[54] FURNACE FOR THE HEAT TREATMENT OF LUMPY TO FINE GRAINED MATERIAL

[75] Inventor: Heinrich Buchner, Bochum-Weitmar, Fed. Rep. of Germany

[73] Assignee: Klöckner-Humboldt-Deutz AG, Fed. Rep. of Germany

[21] Appl. No.: 3,726

[22] Filed: Jan. 15, 1979

[30] Foreign Application Priority Data

Aug. 18, 1978 [DE] Fed. Rep. of Germany ..... 2836162

[51] Int. Cl.[3] ..... F27D 1/08

[52] U.S. Cl. ..... 432/96; 432/99; 432/101; 416/96 R

[58] Field of Search ..... 432/1, 14, 95, 96, 99-101; 416/96 R; 415/213 B

[56] References Cited

U.S. PATENT DOCUMENTS

| | | | |
|---|---|---|---|
| 1,713,237 | 5/1929 | Morin | 432/96 |
| 2,345,067 | 3/1944 | Osann | 432/99 |
| 2,393,963 | 2/1946 | Berger | 416/96 R |
| 2,455,313 | 11/1948 | Osofsky | 416/96 R |
| 2,778,601 | 1/1957 | Eckert | 416/96 R |
| 2,883,151 | 4/1959 | Dolida | 416/96 R |
| 2,948,521 | 8/1960 | Heiligenstaedt | 432/101 |
| 2,952,441 | 9/1960 | Jones | 416/96 |
| 3,311,344 | 3/1967 | Yost | 416/96 |
| 3,544,096 | 12/1970 | Buchner | 432/99 |

FOREIGN PATENT DOCUMENTS

| | | | |
|---|---|---|---|
| 1440786 | 4/1966 | France | 432/99 |

*Primary Examiner*—Henry C. Yuen

*Attorney, Agent, or Firm*—Hill, Van Santen, Steadman, Chiara & Simpson

[57] ABSTRACT

A furnace is disclosed for the heat treatment of mainly lumpy to fine grained material. The furnace is either a shaft furnace or a rotary furnace for the calcination or sintering of limestone, dolomite or magnesite. The calcination material passes through a preheating zone, a calcination zone and a cooling zone. The calcination zone has a gas feed and gas withdrawal device. A calcination device is provided in the calcination zone to which is connected a gas conveying device for the production of a hot gas circulation. The hot gas circulation device is situated between the gas withdrawal device and the calcination device and is provided as a conveying blower subjected to a cooling liquid.

10 Claims, 2 Drawing Figures

FURNACE FOR THE HEAT TREATMENT OF LUMPY TO FINE GRAINED MATERIAL

BACKGROUND OF THE INVENTION

The invention relates to a furnace for the heat treatment of mostly lumpy to fine grained material, particularly shaft furnaces, rotary furnaces or the like. The furnace functions for the calcining or sintering of limestone, dolomite or magnesite, and wherein the calcining material passes through a preheating zone, a calcining zone, and a cooling zone. The calcination zone has a gas feed or gas discharge device, respectively, and a calcination device as well as a gas-conveying device for the production of a hot gas circulation.

From German Pat. No. 1,034,090, a transverse flow shaft furnace is known which has gas collecting devices and heating devices. The hot gases required for the sintering of the calcining material are collected after flow-through of the material layer in the gas collecting devices and are reheated in the heating devices by means of injectors for the gas circulation. The conveyor means required for the gas circulation are in this connection provided as rigid injectors which circulate an essentially constant volume of fed-through hot gases. Disturbances occur with such a transverse or cross flow shaft furnace especially when, on account of an altered bulk density in the shaft and therefore altered pressure drag in the material column, the gas volume available to the particular injector is altered.

From the German Pat. No. 1,558,057, a shaft furnace heated by transverse flow for the calcination of limestone is known, which has in the passage direction of the material a preheating zone, two calcination zones, and a cooling zone, whereby each calcination zone has quasi-closed hot gas circulation. The hot gas circulation is carried out such that each calcination zone is correlated with at least one jet blower or injector, respectively, which produces the kinetic energy necessary for the hot gas circulation. The circulation of the hot gases takes place from the injector into a calcination chamber, a gas collection chamber, the correlated calcination material layer, the discharging gas collection chamber, and through a circulation channel back to the injector. In the calcination chamber, fuel, and, as combustion air, cooling air from the cooling zone is introduced. Through the intensive hot gas circulation there results a very uniform calcination over the entire shaft cross-section. It has been shown, however, that with the trend towards always larger furnace units, that the initiation of jet blowers or injectors causes limits to be established for the maintenance of the gas circulation in each calcination zone. These limits have to do particularly with the high construction cost for these injectors. In the second place, with these injectors, for each calcination zone with large furnace units, only insufficient drops in pressure of up to about 70 mm water column can be produced, so that with the large furnace units, the kinetic energy required for the hot gas circulation can no longer be produced with injectors. Therefore, only furnace units up to 120 tons output per day are known.

SUMMARY OF THE INVENTION

Starting with the state of the art evaluated above, it is an object of the present invention to provide an improved heat-treatment furnace, particularly a shaft furnace for the calcination or sintering of limestone, dolomite or magnesite, so that with simple construction means, furnace units up to 400 tons per day output with low specific energy consumption and high thermal degree of efficiency may be constructed.

This object is attained in that within the hot gas circulation, there is preferably arranged between the gas discharge device and the calcination device as a gas conveyor device a feed blower acted on with cooling means. Therefore, it is for the first time possible to provide directly in the hot gas circulation an optimally controllable gas conveyor device, which, in contrast with the rigid injectors previously used, produces in the calcination zone a drop in pressure of about 300 mm. water column, so that far greater quantities of gas per unit time may be concentrated on the calcination material to be calcined or sintered. This conveyor blower acted on with a cooling means may accordingly convey hot gases up to about 1200° C. in circulation between the gas withdrawal device and the calcination device, without the blower being subjected to thermal limiting stresses. The expensive construction structures for the arrangement of the injectors on the calcination shaft are eliminated, so that in all, the investment costs for the furnace installation may be appreciably lowered.

In a development of the invention, it is provided that with a shaft furnace heated with transverse current with at least one calcination zone and gas supply or gas discharge chambers respectively arranged laterally on the shaft and correlated with each calcination zone, the cooled gas conveyor blower is arranged in the hot circulation channel between the gas withdrawal chamber and the calcination chamber, whereby an especially compact and sturdy furnace construction is attained.

In a development of the invention, the conveyor blower is arranged outside on the shaft, and has its cooling apparatus attached with a closed loop cooling means conduit. This has the advantage that highly effective cooling means are supplied to the blower in a closed circulation, so that an exact adjustment of the temperatures may take place on the blower and the blower parts are in no case subjected to undesired high temperature ranges. In the second place, volatile constituents which are inclined to caking in the hot gases, are crystallized out directly on the relatively cold blower components and are re-conveyed back as solid components into the material fill, without the blower manifesting any cakings even with a very high content of volatile harmful components in the hot gases. Therefore high reliability operation of the blower and therewith of the entire furnace installation is attained.

In a further embodiment of the invention, the heat exchanger of the blower or fan cooling apparatus serves as a heat exchanger for the fuels introduced into the calcination chamber. Therefore, an optimal utilization of the heat provided by the blower or fan is attained, and, particularly with oil-heated calcination chambers, through the preheating of the fuels, more rapid gasification in the calcination chamber and an optimal combustion without ignition delay is attained.

In a further embodiment of the invention having a conveyor fan or blower, the blower shaft and/or the blower impeller or fan is constructed in hollow fashion and, in the blower hollow shaft or in the blower hollow fan, cooling means guiding devices are arranged, preferably cooling means conduits such that the blower parts may be cooled where the thermal load by means of the hot gases in the greatest. For this purpose the cooling means conduits of the blower shaft are in connection through a stationary distributor head with the stationary cooling means conduits of the heat exchanger, which advantageously is constructed as a honeycomb radiator or tubular radiator having air flowing therethrough. This embodiment is of advantage particularly when no fuel preheating is required with the heat exchanger, as for example with coal dust. The heat exchanging of the cooling means then takes place advantageously with the aid of a cooler having air flowing therethrough.

In a preferred embodiment of the invention, the cooling means conduits in the hollow shaft of the blower are formed of a hollow cylinder aligned coaxially and spaced with respect to the hollow shaft. Therefore, through the resultant outer annular chamber the cooling means is supplied, and through the hollow cylinder the cooling means is discharged. With respect to the stationary distributor head, this results in an optimal conveyance of cooling means with the lowest hydraulic resistance. It is further suitable that the cooling means conduit in the blower fan or impeller advantageously runs in a meandering direction at the outer end of each fan blade, whereby it is insured that where high heat loads are to be expected on the blower blades, an optimal discharge of the heat through increased supply of cooling means is attained.

Additionally, the hollow wheel of the blower may be joined through connecting conduits in the wheel hub with the hollow cylinder in the blower shaft, so that by simple construction, an optimal cooling means circulation is attained, particularly on the thermally stressed parts of the blower.

In a further preferred embodiment of the invention, it is provided that the conveyor blower and/or the blower parts are cooled by a cooling means, advantageously by means of a temperature-resistant, organic or inorganic liquid, which has a boiling point of more than 100° C. and circulates in the closed circuit. Through this technique, with relatively low liquid temperature, a high heat discharge and therefore an improved cooling of the individual blower parts is attained, whereby peaks of heat on the blower parts may be diminished. In addition, the cross-sections of the cooler means conduits are selected so small, that even in complicatedly shaped blower parts, cooling means conduits may be disposed. Through the closed circulation of the cooling means, expensive, highly effective cooling means may be utilized, since new cooling liquid need not be constantly supplied.

In a development of the invention, it is further provided that the cooling liquid for the blower is a heat carrying oil, particularly a silicon-oil, whereby it is attained with advantage that an operating temperature desired of more than 100° C. is attained with a cooling means of the type commercially used. It is suitable that the operating temperature of the liquid is adjusted between 200° and 270° C., and preferably between 200° and 220° C.

Furthermore, it is provided in an embodiment of the invention that the cooling liquid circulation for the conveyor blower is supervised by means of pressure controls, thermostats, flow meters, etc. Therefore, a directly operable reliable system is available for the supervision of the cooling circulation which immediately indicates a rise in temperature and/or a disturbance in flow-through of the cooling liquid, so that immediate countermeasures may be initiated. Therefore, a reliable cooling of the blower with reference to the characteristics of the material is insured.

DESCRIPTION OF THE PREFERRED EMBODIMENTS

Figure 1:
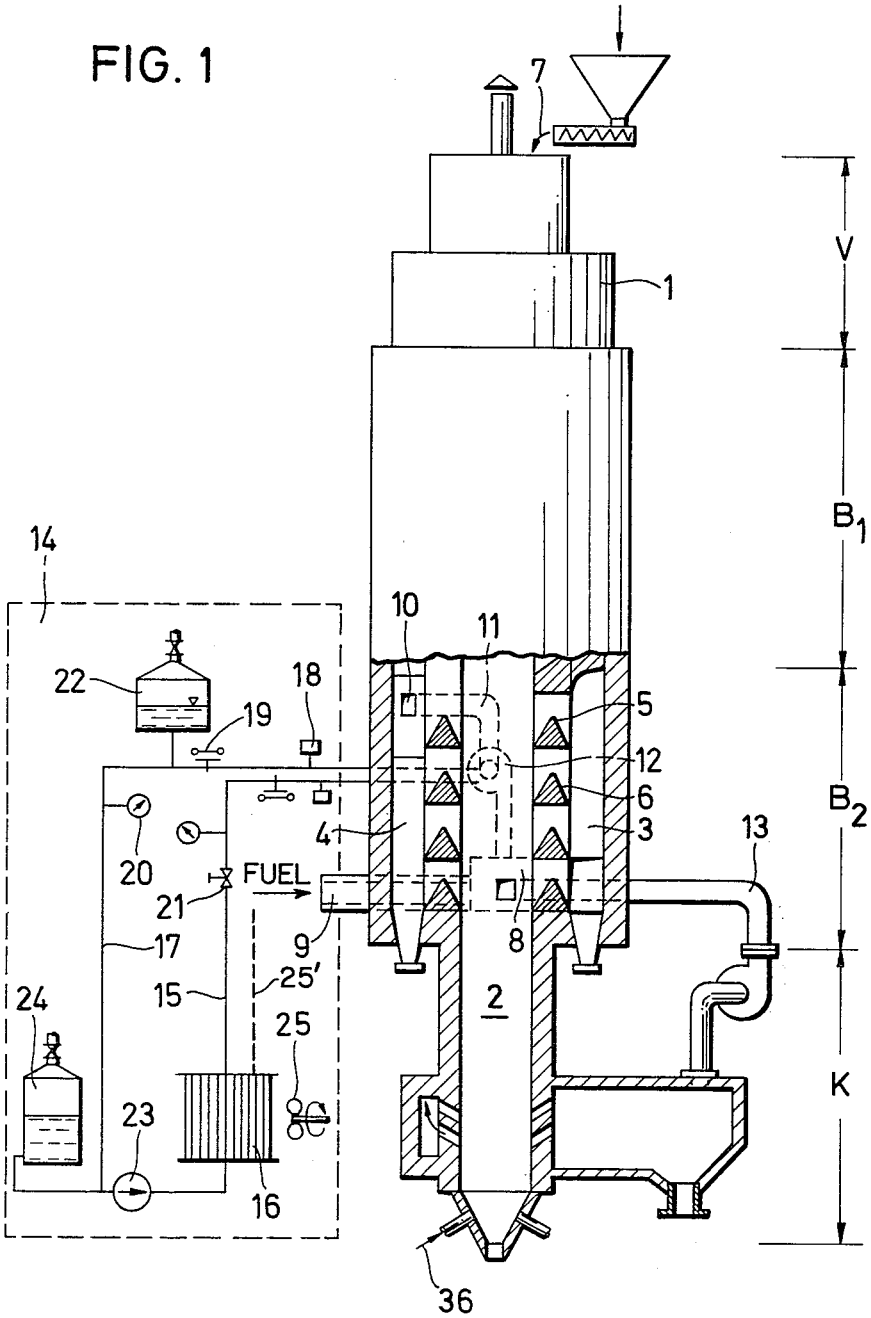
FIG. 1 is a transverse current shaft furnace, partially in section, having a cooled blower arranged in the hot gas circulation system of the calcination zone.

In FIG. 1 is shown a transverse current heated shaft furnace 1, partially in section. The furnace shaft 2 is separated into an upper preheating zone V, two calcination zones $B_1/B_2$ arranged thereunder, and a cooling zone K. At the lower shaft end is located an apparatus, not illustrated in greater detail for the continuous withdrawal of the burnt material.

In the calcination zone $B_2$ as well as also in the calcination zone $B_1$ above and not shown in greater detail, the rectangular shaft 2 consists of two gas collecting chambers 3 and 4, arranged at both sides of the shaft, of which, the gas collection chamber 3 illustrates the gas supply chamber, and the gas collection chamber 4 the gas withdrawal chamber. Between these two chambers extends the shaft wall 6 provided with gas passage openings 5. Within the shaft moves the calcination material 7 from above downwardly in a dense combustion or calcination material column. The gas supply chamber 3 is in connection with a calcination chamber 8 in which a calcination device 9 and a fresh-air conduit 13 is provided through which hot air is conducted out of the cooling zone K as combustion air into the calcination chamber 8. The gas withdrawal chamber 4 has in the upper area a withdrawal opening 10 to which is attached a circulation channel 11, which is guided into the calcination chamber 8. In the circulation channel 11 is arranged a conveyor blower 12 acted on by cooling means for the maintenance of a closed hot gas circulation in the calcination zone $B_2$. As the case may be, to the circulation channel 11 may be attached a branch conduit from the fresh-air conduit 13. The calcination chamber 8, the calcination device 9 and the conveyor blower 12 arranged in the circulation channel 11 are additionally arranged outside of the shaft as shown in broken lines.

The conveyor blower 12 is attached to a cooling apparatus 14 arranged outside of the shaft with closed circuit cooling means. The feed of the cooling liquid to the hot gas blower 12 takes place in this connection through the conduit 15 and the return to the air-cooled heat cooler 16 through the conduit 17. In the conduits 15, 17 are located the measuring and regulating devices required for the supervision of the circulation of cooling means, and indeed in each case in each feed and return conduit 15, 17 a pressure monitor 18 and an emergency thermostat valve 19. Furthermore, the conduits 15 and 17 have flowmeters 20 for the cooling liquid which are constructed as aperture measuring devices with differential pressure manometers. For the rapid shut-off of the supply of cooling means, there is arranged in the conduit 15 a pneumatic valve 21.

In the conduit for discharge of cooling means 17 there is arranged at the highest point of the circulation an equalization container 22 for the equalization of the change in volume of the cooling liquid and in front of the cooling means pump 23 is located an in-fill and after-fill container 24 for the cooling means. The honeycomb radiator 16 is air-cooled and is equipped with a controllable cooling blower 25. A heat exchange 25' with the fuel for the calcination device 8 is also shown in schematic fashion by a dashed line.

Figure 2:
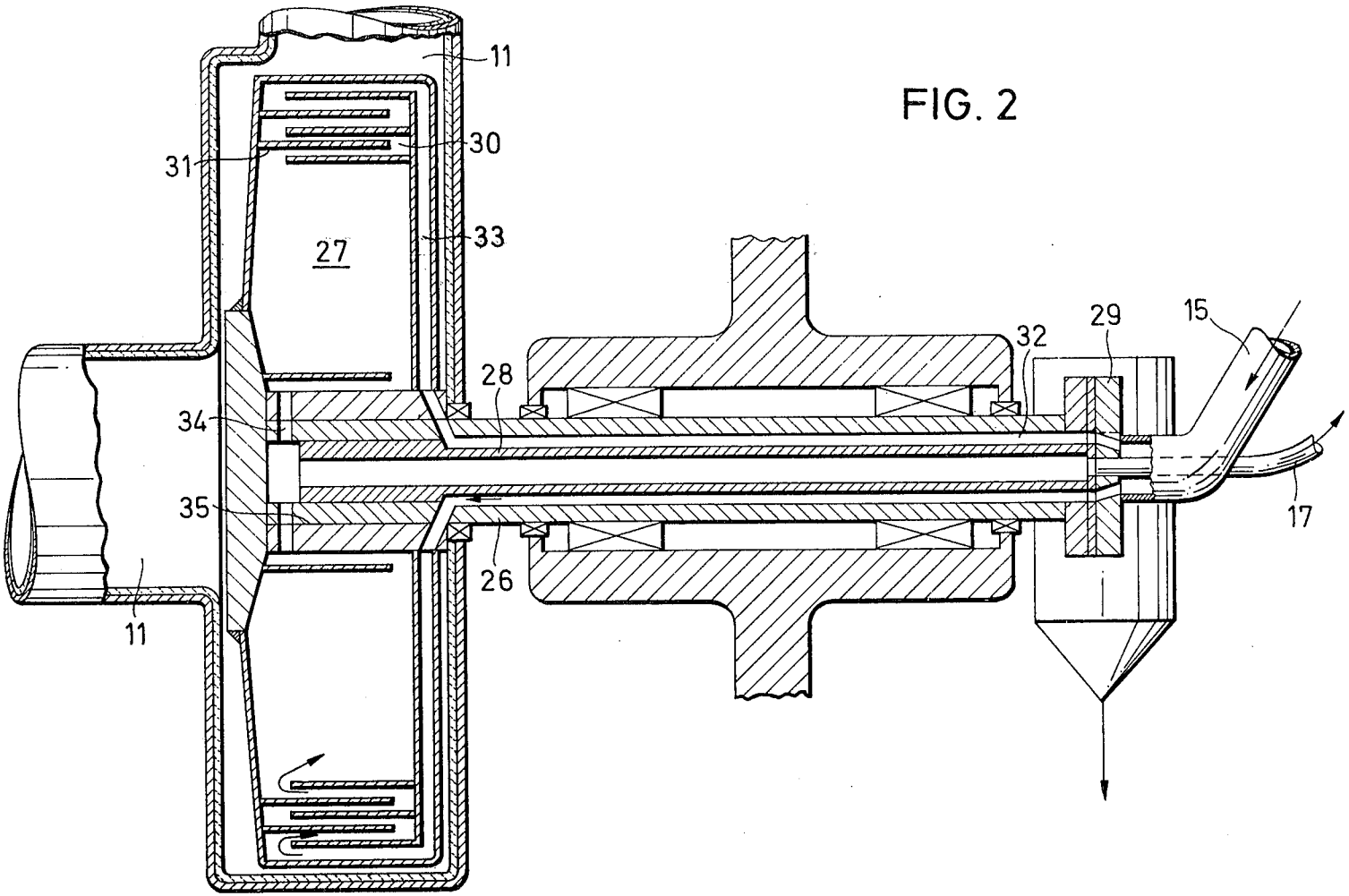
FIG. 2 is an enlargement in longitudinal section through the cooled conveyor blower.

In FIG. 2 is shown on an enlarged scale the conveyor blower 12 particularly blower shaft 26 and blower fan wheel 27 for radial expulsion of air relative to an axis of the blower shaft and which is arranged outside on the shaft of the circulation channel 11. Both the blower shaft 26 as well as the blower wheel 27 are constructed in hollow fashion. In the hollow shaft 26 of the blower is arranged in coaxial spaced fashion a hollow cylinder 28 such that through the resulting outer annular chamber 32 the cooling means is supplied and is conveyed off through the hollow cylinder 28. The cooling means annular chamber, as well as also the hollow cylinder, are in connection through a stationary distributor head 29 with the stationary cooling means conduits 15 and 17 which form with the air flow honeycomb radiator 16 in FIG. 1, a closed circulation for cooling means. The distributor head 29 is surrounded by a leakage housing, known per se.

In the blower fan wheel 27 likewise constructed hollow, there are arranged on the outer end of each wheel blade 30 meandering baffle plates 31, to which the cooling means is conveyed from the annular chamber 32 of the blower shaft 26 through a conduit 23 arranged in the blower wheel. The inner chamber of the hollow wheel 27 of the blower is connected with the hollow cylinder 28 through a connecting conduit 34 which is arranged in the wheel-hub 35 of the blower wheel 27.

The operation of the above described transverse current heated shaft furnace with cooler blower for the production of a closed hot gas circulation in the particular calcination zone B will now be described. The hot gases produced in the calcination chamber 8 flow out of the calcination chamber into the gas collection chamber 3. From there the hot gases pass through the gas passage apertures 5 in the shaft wall 6 transversely to the passage direction of the calcination material into the densely packed calcination material layer, and then to the other side of the fill through the gas passage apertures 5 into the gas withdrawal chamber 4 and are collected there. From the gas withdrawal chamber 4, the hot gas is sucked through the withdrawal aperture 10 in the circulation channel 11 by means of the conveyor blower 12 which lies directly in a hot gas stream of approximately 800° C. to 1200° C. The conveyor blower 12 conveys the hot gas to the calcination chamber 8, into which fuels are introduced through the calcination device 9. There the fuels burn in an atmosphere enriched with oxygen, and with preheated fresh air. In this manner, there is supplied to the hot gas circulation in each calcination zone B the kinetic energy required for the multiple circulation of the hot gases in the calcination zone, whereby, with the blower within each calcination zone, an exact pressure drop adjustment of at least 350 mm water column is made possible. Therefore, an intensive gas circulation with a high volume of output is produced so that the quantity of heat is supplied to the calcination material located in the calcination zone even at a high calcination material feed through. This quantity of heat is necessary for an optimal combustion, so that even the finest stones may be burned.

In order to prevent the gases from flowing through the shaft 2 in an upward vertical direction, there are arranged between each calcination zone $B_1/B_2$ dense zones which prevent downflow of the hot gases into the calcination zone or preheating zone, respectively lying thereabove. The calcination material dropping into the cooling zone K out of the calcination zone is cooled in the same through cooling air 36 at a corresponding processing temperature, and processed further through withdrawal members not shown in greater detail. The cooling air heated in the cooling zone gives off to the calcination chamber 8 as combustion air the quantity of heat taken from the calcination material.

A portion of the hot gases produced in the calcination zones $B_1$ and $B_2$ is deflected from the calcination zones and is conveyed through conduits extending into the furnace 1, not shown in greater detail, to the lumpy material in the preheating zone for preheating.

The conveyor blower 12 is in connection through the distributor head 29 with a closed cooling circulation 14 which is constructed as described above. The cooling of the blower with the cooling apparatus takes place by means of a temperature resistant heat carrier oil, particularly a silicon oil, which is regulated at an operating temperature between 200° C. and 220° C. In the stationary cooling means conduits of the cooling apparatus 14, corresponding regulating devices such as pressure monitor 18, thermostat valve 19 and flowmeter 20 are arranged for the carrier oil. It is therefore possible to cool all blower parts lying in the hot gas flow (approximately 800° C. to 1200° C.) of the circulation channel 11, so that their temperature lies reliably below the maximal thermal stress of the material inserted. On the other hand, through the blower parts lying in the hot gas current heated to a maximum of 240° C., the harmful alkali or sulphur compounds inclined to caking are cooled in a shock manner out of the calcination material and crystallized out of the hot gases so that no deposits may form on the blower or on the blower blades, respectively, which either negatively influence the output characteristics of the blower or, however, lead to increased bearing loads on the blower. Through the use of the blower (cooled in closed circulation with a heat carrying oil) directly in the hot gas circulation of the calcination zone of a shaft furnace heated with a transverse flow, it has become possible for the first time to produce in each calcination zone such a high drop in pressure and to provide therewith such a high kinetic energy for the hot gas circulation, that furnace units are possible which have double the output compared with the transverse current furnaces previously equipped with injectors.

The present invention is limited not only to shaft furnaces heated with transverse current for the calcination or sintering of limestone, dolomite or magnesite, but it may also be used where blowers must be inserted directly in a hot gas current, in order to produce for the gas requirement the required kinetic energy.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A shaft furnace for the high volume calcination or sintering of mainly lumpy to fine grained material including limestone, dolomite, or magnesite, comprising: a shaft having a preheating zone through which the material passes; a calcination zone in the shaft; a cooling zone in the shaft; said calcination zone having associated therewith a gas feed device, a gas withdrawal device, a calcination means for producing hot gas, and a gas conveying device means for circulation of the hot gas which is contaminated with constituents inclined to caking; the hot gas circulation device means including a conveying blower arranged outside the shaft acted on with cooling means and being situated between the gas withdrawal device and the calcination means; and said conveying blower having a radial airflow of the hot gas perpendicular to an axis of rotation of a fan wheel of the blower, and the fan wheel being attached to an external closed circuit cooling apparatus with cooling liquid therein.

2. A furnace according to claim 1 wherein the furnace shaft is heated with the hot gas in a transverse flow, the furnace also having the gas feed and withdrawal devices as chambers arranged laterally on the shaft and correlated with the calcination means.

3. A furnace according to claim 1, characterized in that the conveyor blower has a blower shaft and a blower wheel both of hollow construction and in the hollow shaft and in the hollow wheel cooling means conduits are arranged.

4. A furnace according to claim 3, characterized in that the cooling means conduits of the blower shaft are in connection through a stationary distributor head with stationary cooling means conduits of a heat exchanger which is cooled by air.

5. A furnace according to claim 4, characterized in that in the stationary cooling means conduits pressure monitors, thermostats, and flowmeters are arranged.

6. A furnace according to claim 3, characterized in that the cooling means conduits in the blower hollow shaft are formed in a hollow cylinder aligned coaxially and spaced from the hollow shaft, and a resulting outer annular chamber means being formed for supplying the cooling means, and the hollow cylinder forming means for carrying away the cooling means.

7. A furnace according to claim 3, characterized in that the blower wheel has blades and the cooling means conduits are provided in the blower wheel at an outer end of each wheel blade in a meandering path.

8. A furnace according to claim 7 wherein the meandering path of the conduits is formed by parallel guide walls inside the wheel blades.

9. A furnace according to claim 3, characterized in that the blower hollow wheel is in connection through connecting conduits in a hub of the wheel with a hollow cylinder in the blower shaft.

10. A shaft furnace for the high volume calcination of material including limestone, dolomite, or magnesite, comprising: a shaft divided into a preheating zone, calcination zone, and cooling zone; the calcination zone having a gas supply chamber in communication with the shaft through apertures, a gas withdrawal chamber opposite the gas supply chamber also in communication with the shaft by apertures, a calcination chamber having a fuel inlet, a fresh air inlet, a hot gas inlet, and a hot gas outlet in communication with the gas supply chamber; a hot gas conveying blower having its output directly connected to the calcination chamber hot gas input, and an input of the blower being connected through an aperture to the gas withdrawal chamber; and the hot gas blower being arranged alongside and exterior to the shaft and having a fan wheel providing a radial expulsion of the hot gas which is contaminated with constituents inclined to caking in a direction perpendicular to an axis of a shaft retaining the fan wheel, the fan wheel having tubes therein for conveying a cooling medium from an external closed curcuit cooling apparatus.

* * * * *